US008221183B2

(12) United States Patent
Matos

(10) Patent No.: US 8,221,183 B2
(45) Date of Patent: Jul. 17, 2012

(54) UNIVERSAL DISC-SHAPED CONNECTORS

(76) Inventor: Jose R. Matos, Plano, TX (US)

( * ) Notice: Subject to any disclaimer, the term of this patent is extended or adjusted under 35 U.S.C. 154(b) by 1674 days.

(21) Appl. No.: 10/841,326

(22) Filed: May 5, 2004

(65) Prior Publication Data

US 2005/0014441 A1 Jan. 20, 2005

Related U.S. Application Data

(60) Provisional application No. 60/468,417, filed on May 7, 2003.

(51) Int. Cl.
*A63H 33/08* (2006.01)
*A63H 33/00* (2006.01)

(52) U.S. Cl. ..... 446/124; 446/386

(58) Field of Classification Search ..... 446/84, 446/124–128, 386, 85; 426/104
See application file for complete search history.

(56) References Cited

U.S. PATENT DOCUMENTS 3,663,717 A * 5/1972 Coster ..... 426/104
4,333,974 A * 6/1982 Davis ..... 428/16
5,447,584 A * 9/1995 Shakespeare et al. ..... 156/63
5,601,470 A * 2/1997 Yao ..... 446/127
5,792,496 A * 8/1998 Fekete et al. ..... 426/104
6,250,986 B1 * 6/2001 Sorensen ..... 446/85
6,443,794 B2 * 9/2002 Oren et al. ..... 446/85
6,511,073 B2 * 1/2003 Simonds ..... 273/299
6,572,429 B2 * 6/2003 Cheung ..... 446/120
6,616,499 B1 * 9/2003 Sorensen ..... 446/85
6,676,474 B2 * 1/2004 Glickman ..... 446/126
2003/0152668 A1 * 8/2003 Griffin ..... 426/104

* cited by examiner

*Primary Examiner* — Kien Nguyen
(74) *Attorney, Agent, or Firm* — Rick Matos; Innovar, L.L.C.

(57) ABSTRACT

The present invention provides a versatile construction kit that can be used to easily form models of virtually any conceivable person, place or thing including a variety of vehicles, buildings, people, animals, weapons, machinery, caricatures, objects and the like. The construction kit comprises plural disc-shaped connectors that are connectable by way of a tongue-and-recessed retainer mechanism and optionally also by way of interconnectable notches by which they can be perpendicularly and detachably interconnected and/or optionally by way of a tongue-in-slot mechanism. The universal connectors are so versatile they can form virtually any geometric, regular, irregular, asymmetric, or symmetric configuration.

19 Claims, 4 Drawing Sheets

UNIVERSAL DISC-SHAPED CONNECTORS

CROSS-REFERENCE TO EARLIER FILED APPLICATION

The present claims the benefit of priority of earlier filed Provisional Application for Patent Ser. No. 60/468,417 filed May 7, 2003, the entire disclosure of which is hereby incorporated by reference.

FIELD OF THE INVENTION

The present invention relates generally to a construction kit, and more specifically, to a construction kit that employs disc-shaped connectors that are connectable by a tab-and-recessed retainer mechanism, or interlocking prong mechanism, and that are available in a range of shapes for building models.

BACKGROUND OF THE INVENTION

Construction kits and connectors are well known. Such items have employed connectors and additional members having a wide range of shapes and sizes including blocks, pyramids, rods, gears, flat panels, discs and the like. Construction kits have been used to build a respective wide range of very crude to semi-realistic models of structures such as airplanes, trains, cars, rockets, buildings, animals and more.

Known construction kits for constructing semi-realistic models generally require a large number of like-shaped connectors and/or a wide range of uniquely-shaped connectors generally being connectable in only one or a limited number of ways. Such construction kits quickly lose a user's interest due to either the extreme effort required or the limited number of structures that can be made. Moreover, known connectors generally form fixed angle connections, which further limits the type of models that can be built.

Known connectors employ a variety of interconnecting and interlocking means such as holes, bosses, notches, grooves, threads, and joints. Those connectors have also been made from a large variety of materials such as wood, plastic, foam and metal.

One widely available connector is the TAZO™ connector. Such connectors are disc-shaped and are available in a variety of geometric shapes such as a circle, square, pentagon, hexagon and the like. Each TAZO™ has four to eight notches on the outer periphery of the disc. The width of the notches approximates the thickness of a TAZO™ connector. TAZO™ connectors are formed into chains and other structures by detachably and perpendicularly interconnecting their notches so that adjacent TAZO™ connectors are substantially perpendicular to each other. Those construction kits are very limited in the types of models they can form.

By interconnecting a varying number of TAZO™ connectors, some very simple geometric structures, such as a circle, sphere, rod, square, cube triangle, rectangle, block, pyramid and the like, can be formed. However, forming semi-realistic models of complicated structures such as airplanes, buildings, animals, automobiles, ships and spaceships, is almost impossible when employing solely TAZO™ connectors and if accomplished generally results in extremely large models that are not very realistic in appearance.

U.S. Pat. No. 6,179,681 to Matos discloses a universal connector toy that employs a tongue-in-slot mechanism. The construction toy requires that the tongue (or tab) be placed within a slot, an aperture in the disc. While that toy is extremely versatile, it limits the angle of entry/approach of the tongue into the slot. The limitation results in a limitation as to the models that can be built. The '681 patent requires insertion of a tab into a slot and not into a recessed retainer.

There remains a need for a construction kit that can form a wide range of semi-realistic models while requiring a limited number of connectors and providing a greater number of ways in which the connectors can be connected.

SUMMARY OF THE INVENTION

The present invention overcomes the disadvantages of known construction kits and thus is generally directed to a versatile construction kit which can be used to easily form a wide variety of semi-realistic models while requiring only a limited number of tab-and-recess (or pronged) connectors. The construction kit can be expanded by the addition of further connectors to permit construction of an even greater variety of semi-realistic models of virtually anything such as, by way of example, buildings, people, animals, toys, weapons, machinery, caricatures, fanciful figures, spaceships, and air, land or water borne vehicles, and the like.

In one aspect, the invention provides a construction kit having a variety of similarly or uniquely-shaped parts for building semi-realistic models. Thus, the present invention provides a construction kit comprising a plurality of substantially planar disc-shaped connectors wherein at least some of the connectors are tongue-and-recessed retainer connectors and wherein a tongue-and-recessed retainer connector comprises:

a substantially planar body having a defined thickness and being defined by an outer periphery;

at least one tongue member in said body being defined by a first portion of the outer periphery, the tongue member having a first distal region and a narrower first proximal region; and at least one recessed retainer in said body being defined by a second portion of the outer periphery, the retainer having a second proximal region and a narrower second distal region;

wherein:

the width of the first proximal region is wider than the width of the second distal region;

the width of the first distal region is wider than the width of the second proximal region; and said tongue member is dimensioned to be retained by said retainer.

The outer periphery can further comprise at least one notch which width generally approximates or is smaller than the thickness of the body. Placement of one or more notches along the periphery of the disc-shaped connectors can vary to permit building a greater number of semi-realistic models. When connected by way of their notches, the connectors of the invention interconnect approximately perpendicularly and detachably.

A disc-shaped connector according to the invention can comprise a plurality of tongue members and as well as a plurality of recessed retainers. The recessed retainer can be spaced apart, connected, adjoining or disposed as desired along the periphery of the body of the connector. Likewise, the tongue members can be spaced apart, connected, adjoining or disposed as desired along the periphery of the body of the connector. Adjacent tabs can be positioned to define a recessed retainer, and adjacent recessed retainers can be positioned to define a tab.

The connectors of the invention can be shaped as desired. For example, they can have a regular, irregular, geometric, asymmetric, symmetric or other shape.

The universal disc-shaped connectors can be provided individually or in groups as individual pieces or in kits or as comprising punch-out cards.

The connectors of the invention can be made of rigid, semi-rigid, or flexible materials, and they can be edible or inedible. When the connectors of the invention are properly connected and are made of the appropriate materials they can form virtually any 2- or 3-dimensional shapes and/or combinations thereof.

As the present construction kit can form semi-realistic models, the surfaces of the connectors can be adorned with any one or more of a wide range of odoriferous, tactile, optic, visual, sensual, graphic, textural, ornamental, image, text features or combinations thereof.

Specific embodiments of the invention include those wherein: 1) the tongue comprises a single element; 2) the tongue comprises two outwardly directed prongs; 3) the recessed retainer comprises or is defined by two inwardly directed prongs; 4) the tongue comprises two prongs that are directed away from each other; 5) the recessed retainer comprises or is defined by two prongs directed toward each other; 6) the connector comprises at least two tongues and at least one recessed retainer; 7) the connector comprises at least two recessed retainers and at least one tongue; 8) the connector further comprises at least one slot adapted to receive and temporarily retain a tongue; 9) the kit further comprises connectors excluding tongue members; 10) the kit further comprises connectors excluding recessed retainers; 11) at least some of the connectors comprise notches disposed along the periphery of the connectors; 12) the connectors further comprise one or more slots adapted to receive and retain a tongue member of another connector; 13) a tab is disposed within a recessed retainer; 14) at least two adjacent tongue members define at least one recessed retainer; 15) the connector comprises plural tongue members and plural recessed retainers; 16) the connector further comprises at least one slot adapted to receive and retain a tongue member; 17) the connector comprises plural, e.g. two or more, prongs that together define at least one tab and at least one recessed retainer; 18) the construction kit is a puzzle; 19) the connector comprises a frame body; and/or 20) the connector comprises a sheet body.

Another aspect of the invention provides an adaptive construction kit comprising plural adaptive connectors, wherein an adaptive connector is capable of changing its size and/or shape upon exposure to a predetermined condition such that a first adaptive connector is adapted to interlock and/or interconnect with a second adaptive connector before and/or after to exposure to the predetermined condition.

Other features, advantages and embodiments of the invention will be apparent to those skilled in the art by the following description, accompanying examples and appended claims.

BRIEF DESCRIPTION OF THE DRAWINGS

The following drawings are part of the present specification and are included to further demonstrate certain aspects of the invention. The invention may be better understood by reference to one or more of these drawings in combination with the detailed description of the specific embodiments presented herein.

DETAILED DESCRIPTION OF THE INVENTION

The invention is a construction kit comprising at least two disc-shaped connectors that can be connected by employing a tongue-in-recessed retainer mechanism and optionally an interconnecting notch-to-notch mechanism and/or a tongue-in-slot retainer. The tongue of the connector is dimensioned to be inserted through the recessed retainer and/or optional slot of the connector. Since the width of the retainer is smaller than the width of the tongue, the connection formed by the tongue-in-recessed retainer design is substantially stronger and less susceptible to accidental disconnection than is the connection formed by the notch-to-notch design. When connected, the disc-shaped connectors of the invention can form fanciful to semi-realistic models of a variety of structures.

By "semi-realistic" is meant appearing to at least some degree as it would in real life or as depicted by a three-dimensional model.

The terms tab and tongue are used interchangeably herein.

Figure 1:
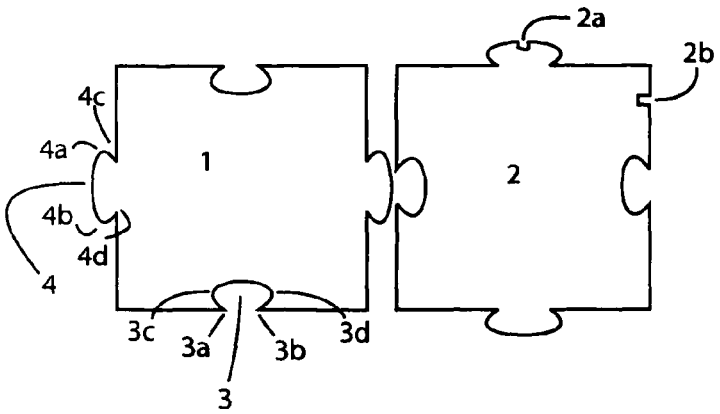
FIG. 1 depicts a top plan view of a first embodiment of two universal disc-shaped connectors of the invention.

FIG. 1 depicts a first embodiment of the disc-shaped connector (1) comprising two tongue members (4) each attached to the body and defined by the outer periphery of the connector. The tongue (4) comprises a proximal region (4*c*, 4*d*) and a distal region (4*a*, 4*b*) with respect to the body of the connector. The width of the proximal region is narrower than the width of the distal region. The outer periphery also defines two recessed retainers (3), each comprising a proximal region (3*c*, 3*d*) and a distal region (3*a*, 3*b*) with respect to the body of the connector. The proximal region of the recessed retainer is wider than the respective distal region. The connector (2) is defined by an outer periphery that includes plural notches (2*a*, 2*b*) located on a tab and adjacent a recessed retainer. The width of notches (2*a*, 2*b*) generally approximates the thickness of connector (1), the tongue member (4), the body and/or the recessed retainer (3). The notches are optional, and if a plurality is present, they can be radially spaced as desired along the outer peripheries of the connector.

The width of the proximal region (3*c*, 3*d*) of the recessed retainer (3) is narrower than the width of the distal region (4*a*, 4*b*) of the tongue (4). Moreover, the width of the distal region (3*a*, 3*b*) of the recessed retainer is narrower than the width of the proximal region (4*c*, 4*d*) of the tongue (4). The tongue member (3) is dimensioned for insertion into and temporary retention by the recessed retainer (3).

By "tongue member" or "tab" is meant a male member which is dimensioned to be inserted within and retained by the recessed retainer of the disc-shaped connector. The tongue member can be shaped as desired. The shape of the tongue member can include any shape such as, by way of example and without limitation, a square, rectangle, circle, oval, ellipse, trapezoid, parallelogram, pentagon, hexagon, heptagon, any polygon, any geometric shape, irregular shape, regular shape, symmetric shape, asymmetric shape and combinations thereof. The tongue member can also be shaped as any known, imaginary or fanciful figure, person, place, or thing or its silhouette. As described below, the tongue member can comprises two or more prongs.

It should be noted that when more than one tongue member is present in a connector, the shape of the connectors can be selected independently and need not be the same. In one embodiment, the tongue members on a single connector are shaped the same. In another embodiment, the tongue members on all the connectors in a construction kit are shaped the same. In another embodiment, the tongue members of a single connector are shaped differently. In yet another embodiment, one or more of the tongue members of a first connector in a kit are different than one or more tongue members of a second connector in the kit. In still another embodiment, one or more of the tongue members of a first connector in a kit are substantially the same as one or more tongue members of a second connector in the kit.

The connector can be any generally flat disc-shaped article. By "disc-shaped connector" is meant a substantially planar, but not necessarily flat, connector having a thickness substantially narrower than the longest length of the connector. Although the body of the connector (1) is depicted with a square shape, the body can be circular, approximately circular, elliptical, rectangular, triangular or other regular, irregular, geometric asymmetric or symmetric shape. The connector (1) generally has a thickness that is at least five fold smaller, preferably seven fold smaller, more preferably 10 fold smaller than its length. By "approximately circular" is meant a multi-sided geometric shape, or polygon, having five or more sides so that the shape will roughly or closely approximate that of a circle. An approximately circular connector can be shaped as a pentagon, hexagon, heptagon, octagon or any multi-sided polygon having nine or more sides.

Figure 15:
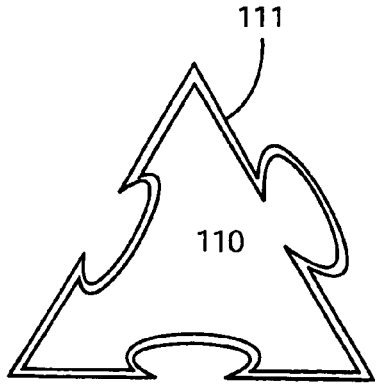
FIG. 15 depicts a top plan view of an exemplary connector comprising a frame body.

While most of the embodiments of the connector herein comprise substantially planar sheet type material, the body of the connector (110) depicted in FIG. 15 comprises a substantially planar frame (111) type material. Accordingly, a connector according to the invention can comprise a frame body. The frame can comprise any sufficiently rigid, and optionally flexible, material such as rope, strand, wire, string, plastic, lace, rubber, leather, metal, board, wood, fiberglass, paperboard, cardboard and other such materials.

Figure 11:
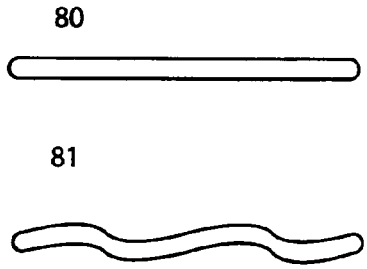
FIG. 11 depicts a side elevation of the two different connectors of the invention.

The connector is generally intended to be substantially planar as exemplified by flat (80), concave, convex, corrugated (ridged; 81) and the other configurations (See FIG. 11). The connector can also have any one or more of depressions, ridges, ribs, bosses, projections, corrugations, indentations, dimples, odoriferous agents, light reflective materials, light absorptive materials, water absorptive materials, water repellent and the like on its surface.

The interlocking mechanism employed by the various connectors of the invention involves a tab-in-recessed retainer design or mechanism wherein the tongue member of a first connector is dimensioned to be inserted into and retained by the recessed retainer of a second connector. According to the materials used to make the connector, the connected connectors may form a substantially perpendicular to substantially planar or coplanar connection by way of the tab-in-recessed retainer mechanism. If the connectors are interconnected by way of notches, the connected connectors will form a substantially perpendicular detachable interconnection. By "substantially perpendicular" is meant that the planes which define respective connectors will be substantially normal to each other when the respective connectors are interconnected. By "interconnecting" is meant employs two snugly fitting parts to form a connection. For example, when the connector (1) is interconnected with the connector (2) by way of any of the notches (2*a*) or (2*b*), they form a snug fitting perpendicular and detachable interconnecting joint.

The tongue-in-recessed retainer design or mechanism of the connectors employed herein are intended to be interlocking. By "interlocking" is meant employs a male tongue member and a female recessed retainer to form a connection which is not easily susceptible to disconnection by opposing forced linear translation (separation) and which involves insertion of the tongue member through the slot. Once interlocked by first placing a tab in the retainer using a skewed approach and then aligning the connectors along a common arbitrary planar axis, the connectors are sufficiently interlocked such that they remain interlocked even after a slight pull by hand of the connectors in opposite direction along the axis of alignment, i.e., such as when the connectors are pulled in opposite directions along a substantially common plane or along closely spaced planes defined by the individual body of each connector.

The connectors of the invention can be rigid, semi-rigid or flexible and can comprise materials such as, by way of example and without limitation, wood, plastic, rubber, cardboard, paperboard, paper, film, metal, laminates, foils, glass, leather, vinyl, combinations thereof and the like. Essentially any material that is not extremely brittle can be used in the connectors of the invention. A connector of the invention is sufficiently pliable yet rigid enough to permit manipulation thereof as required to connect to another connector.

The connector can comprise a lens material, e.g. lenticular, fresnel, bird's eye, fly's eye, complex or simplex lens. The connector can comprise an associated coded image adapted for decoding (viewing) by the lens material.

Edible connectors can be made with any edible material that retains sufficient rigidity, and optional flexibility, to function properly as a connector. The edible material should be sturdy enough to maintain its physical integrity during use as desired. Suitable materials include starch, flour, oat, wheat, cellulose, starch derivative, cellulose derivative, carbohydrate, carbohydrate derivative, sugar, protein, milk, whey, combinations thereof and any other edible material. Edible connectors can also include a preservative, plasticizer, antioxidant, salt, flavor, bicarbonate, baking soda, yeast, oil, butter, glycerin, polymer, glycol, glycol derivative, grease, shortening, egg, albumin, adsorbent, buffering agent, desiccant, colorant, flavorant, sweetening agent, binder, disintegrant, opaquant, other edible materials and combinations thereof.

When a connector kit is a puzzle, the connector pieces can comprise image portions and/or textured portions that cooperate to form one or more solved puzzle arrangements when the pieces are interlocked in a predetermined manner.

According to one embodiment, edible connectors can be connected to form a model that is then treated (processed) to change the model. For example, a group of edible connectors made from flour, starch and other materials are connected to form a two- or three-dimensional model. The model is then cooked, either in hot oil, boiling water, a conventional oven, a convection oven, or a microwave to cause expansion of the pieces and thereby expansion of the model. Another exemplary group of connectors comprise a water expandable material, such as dehydrated and/or compressed sponge, gel or hydrogel, such that the connectors expand when exposed to water. Accordingly, the invention provides an adaptive connector kit comprising plural, optionally edible, connectors that are adapted to interconnect and/or interlock to form a two- and/or three-dimensional model, wherein the connectors are adapted to change in size and/or shape upon exposure to a predetermined condition. The predetermined condition can be heat, cold, desiccation (drying), moisture, an aqueous composition (such as water, a water containing mass, a water containing fluid, steam, vapor, and other such materials or conditions), an oil-based composition, a non-aqueous composition, acidic composition, alkaline composition, any condition capable of changing the shape and/or size of the connectors, or a combination thereof. Suitable materials for making the adaptive connector the connector include, by way of example and without limitation, a heat expandable material, heat shrinkable material, cold expandable material, cold shrinkable material, desiccation expandable material, desiccation shrinkable material, water expandable material, water shrinkable material, oil-based composition expandable material, oil-based composition shrinkable material, non-aqueous composition expandable material, non-aqueous composition shrinkable material, acidic composition expandable material, acidic composition shrinkable material, alkaline composition expandable material, alkaline composition shrinkable material, organic solvent expandable material, organic solvent shrinkable material, or a combination thereof.

An adaptive connector according to the embodiment can comprise any type of construction piece(s). An adaptive connector need only be able to change in size and/or shape upon exposure to a predetermined condition. The adaptive connector can be adapted to interlock and/or interconnect with another connector before and/or after exposure to the predetermined condition. An adaptive connector can be an interlocking connector, an interconnecting connector, a press-fit connector, a snap-fit connector, a slide-fit connector, a tongue-in-slot connector, a tab-in-recessed retainer connector or a combination thereof.

When a model is made of adaptive connectors, the connectors can be adapted to become dislodged upon exposure to the predetermined condition. Alternatively, the connectors can be adapted to become interlocked and/or interconnected upon exposure to the predetermined condition. For example, an adaptive kit can form a soccer ball shaped model of a first size comprising hexagon and pentagon shaped connectors. After exposure to the predetermined condition, the ball decreases or increase in size and/or the ball changes shape.

The dimensions of an adaptive connector will change by exposure to the predetermined condition. Therefore, the adaptive connector can be made so that it does not interlock with another connector until after it has been exposed to the predetermined condition. For example, a water swellable adaptive connector, e.g. a desiccated sponge or gel material, can be made interlockable by exposure to water such that the dimensions of the interlocking or interconnecting mechanism of the connector change, e.g. increase in size, by exposure to water. Alternatively, the adaptive connector can be made so that it interlocks with another connector only before it has been exposed to the predetermined condition. For example, an acid swellable, acid shrinkable, alkali swellable or alkali shrinkable material can be used to make the adaptive connector. If an acid swellable material is used, the adaptive connector can be swelled by exposure to acidic medium. If an alkali shrinkable material is used, the adaptive connector can be shrunk by exposure to alkaline medium.

In one embodiment, a kit comprises plural adaptive connectors that do not interlock or interconnect until after they are exposed to a predetermined condition. In another embodiment, a kit comprises plural adaptive connectors that interlock or interconnect before and, optionally after, they are exposed to a predetermined condition.

The term "slot" is taken to mean any aperture disposed in the body of the disc-shaped connector of the invention and which is dimensioned to receive a tongue member as herein described. Although a slot can generally be of any desired shape, it is so shaped as to permit complete insertion of the tongue member and at least temporary retention of the tongue member therein. The length of the slot approximates or is smaller than the width of the distal region of the tongue member. The length of the slot can approximate but is preferably larger than its width. The shape of the slot can be selected as desired. For example, the slot can have a regular, irregular, geometric, symmetric, asymmetric shape or combinations thereof. Plural slots can be disposed anywhere on a connector of the invention. They can be separate or connecting.

The notch of a first connector need only be sufficiently wide to permit detachable and perpendicular interconnection with the notch, edge or body of a second connector. It should also be noted that the notches can have different lengths. For example, the notches of the connector can be as long as they are wide, i.e. its length approximates its width, or they can be longer than they are wide. As well, it is contemplated that the angle of incidence of the notches relative to the outer periphery of the connector can be varied.

Since the connectors of the invention preferably have a plurality of radially spaced tongue members and optionally notches on their outer peripheries, models employing them can advantageously be constructed in a variety of different forms thereby enhancing their semi-realistic appearance.

Since a construction kit according to the invention will comprise plural tongue-in-recessed retainer disc-shaped connectors, the construction kit can comprise at least one and preferably more than one type or embodiment of a disc-shaped connector. FIGS. 1-11 depict various exemplary embodiments of the disc-shaped connector that differ in the number, shape and disposition of their tongue members, slots, recessed retainers, and optional notches.

Figure 2:
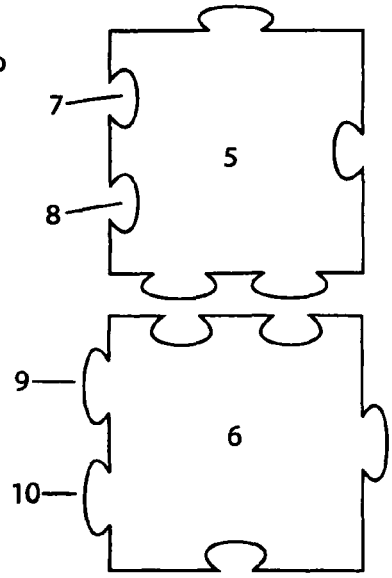
FIG. 2 depicts a top plan view of a second embodiment of two universal disc-shaped connectors of the invention.

In FIG. 1, the connectors (1, 2) each comprises two recessed retainers (3) and two tabs (4) as defined by the outer periphery of the connector. Moreover, the connector (2) further comprises two slots (2*a*, 2*b*) defined by the outer periphery. The notches can be located anywhere along the outer periphery of the body of the connector (2). In FIG. 2, the connectors (5, 6) each comprise two adjacent tabs (9, 10) and two adjacent recessed retainers (7, 8). The connectors (5, 6) are adapted to interlock by way of the paired tabs and recessed retainers and/or by way of the individual tabs and recessed retainers.

Figure 3:
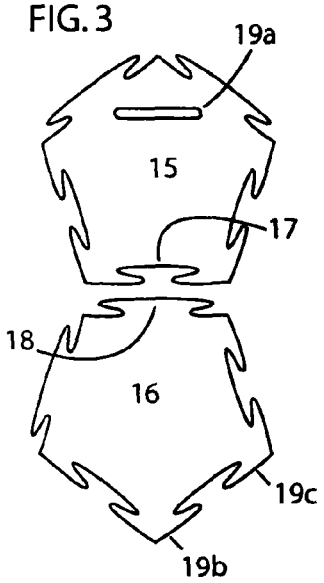
FIG. 3 depicts a top plan view of a third embodiment of two universal disc-shaped connectors of the invention.

FIG. 3 depicts a pair of connectors (15, 16) comprising plural tabs (18, 19*b*, 19*c*) and plural recessed retainers (17) that are adapted to interlock with the tabs. The two tabs (19*b*, 19*c*) define a recessed retainer. The connector (15) further comprises a slot (19*a*) adapted to interlock with a tab (18). The tabs (19*b*, 19*c*) are located on the apexes of the pentagon-shaped connector; whereas, the tabs (18) are located along the faces (edges) of the connector.

Figure 4:
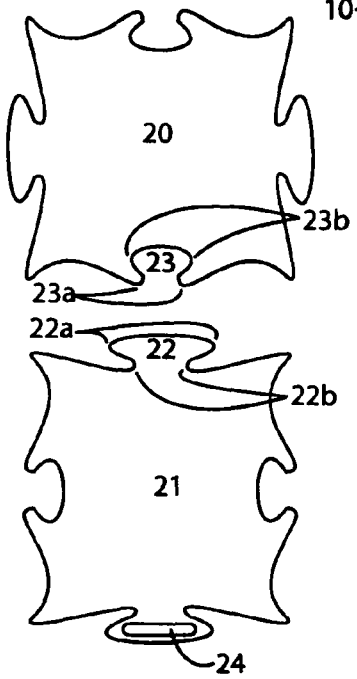
FIG. 4 depicts a top plan view of a fourth embodiment of two universal disc-shaped connectors of the invention.

The connectors (20, 21) of FIG. 4 are symmetrical and regularly shaped. They comprise arcuate edges (faces) of a substantially rectangular body. The connectors comprise plural tabs (22) and plural recessed retainers (23). A tab comprises a wider distal region (22*a*) and a narrower proximal region (22*b*). At least one tab comprises a slot (24) adapted to interlock with another tab. The recessed retainer comprises a wider proximal region (23*b*) and a narrow distal region (23*a*) defined by two prongs that point to one another. The connector (20) can interlock with the connector (21) by way of a recessed retainer and/or a slot.

The invention includes kits comprising plural connectors according to the invention and optionally further comprising one or more connectors not according the invention. For example, a first kit comprises plural connectors wherein each connector comprises a recessed retainer and a tongue (tab) as described herein. Another kit further comprises connectors comprising only one or more tabs, only one or more recessed retainers, or only one or more slots. That other kit can comprise plural different types of connectors where not all of which are according to the invention.

Figure 5:
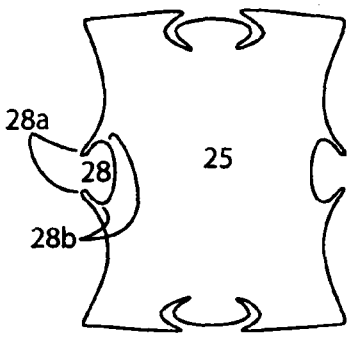
FIG. 5 depicts a top plan view of a fifth embodiment of two universal disc-shaped connectors of the invention.

FIG. 5 depicts two connectors (25, 26) each of which comprises two tabs (27) and two recessed retainers (28). The tabs are actually recessed tabs, meaning that they are recessed within the substantially rectangular outer perimeter defining the body of the connector. The recessed retainer (27) is defined by the opposing apexes (27*a*) and the respective channels (recesses; 27*b*). The recessed retainer is defined by two spaced apart prongs (28*a*, 28*b*) that are pointed substantially toward the general direction of one another.

Figure 6:
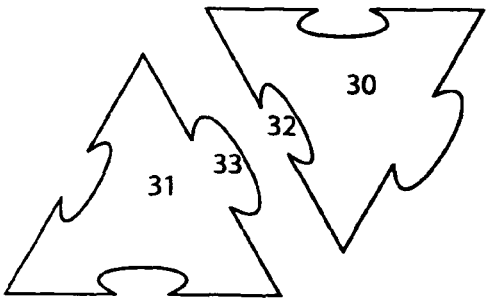
FIG. 6 depicts a top plan view of a sixth embodiment of two universal disc-shaped connectors of the invention.
Figure 6:
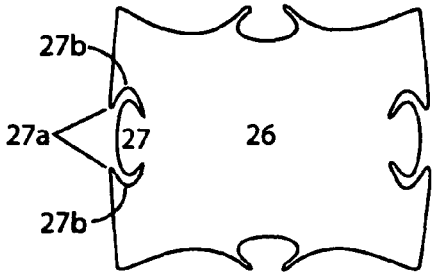

Each of the triangular connectors (30, 31) depicted in FIG. 6 comprises two recessed retainers (32) and one tongue member (33). When six of the connectors are interlocked, they can form a substantially flat hexagon or diamond. When four are interlocked, they can form a pyramid or larger triangle. The shapes that the connectors of the invention can form are not limited.

Figure 7A:
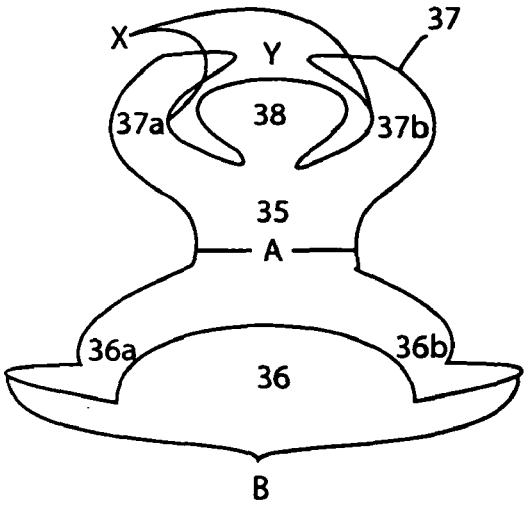
FIG. 7*a* depicts a top plan view of a seventh embodiment of a universal disc-shaped connector of the invention.
Figure 7B:
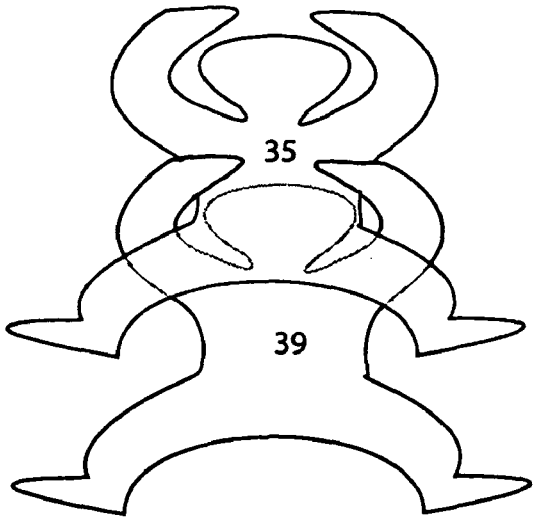
FIG. 7*b* depicts a top plan view of a seventh embodiment of two interlocked universal disc-shaped connectors of the invention.
Figure 8:
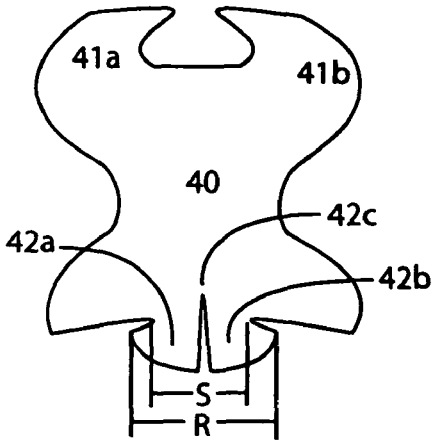
FIG. 8 depicts a top plan view of an eighth embodiment of two universal disc-shaped connectors of the invention.
Figure 8:
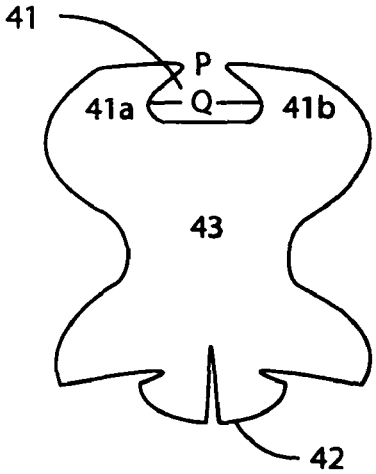

FIG. 7 depicts a connector (35) shaped like the silhouette of a person, figure or character. The connector comprises a recessed retainer defined by two arms (prongs; 37*a*, 37*b*). The distal region of the recessed retainer has an inner width (Y) defined by the innermost opposing edges of the distal region. The more proximal region of the recessed retainer has an inner width (X) defined by the innermost opposing edges of the proximal region. The connector also comprises a bifurcated tab (36) defined by outwardly extending prongs (36*a*, 36*b*), which distal region has an outer width (B) that exceeds the inner widths (X, Y) of the recessed retainer (37). The proximal region of the tab has a width (A) that also exceeds the inner widths (X, Y) of the recessed retainer. The recessed retainer has another tab (38) disposed within the recessed retainer; however, the tab (38) is only optionally adapted to interlock with a recessed retainer or slot of another connector. FIG. 7*b* depicts two interlocked connectors (35, 39). The recessed retainer of one connector is adapted to retainer the tab of another connector. The tab (38) can exert pressure upon the other connector in opposition to the pressure being exerted on the connector by the prongs of the recessed retainer.

The shape of the tab can be made as desired. It need only have a distal region wider than the proximal region of a corresponding recessed retainer with which it is adapted to interlock. The connectors (40, 43) comprise a recessed retainer (41) defined by two inwardly directed prongs (41*a*, 41*b*), wherein the distal region of the recessed retainer has an inner width (P) that is narrower than the width (Q) of the proximal region of the recessed retainer. Each connector also comprises a split tab (42) comprising two outwardly extending prongs (42*a*, 42*b*), which distal region has a Width® and which proximal region has a narrower width (S). The two prongs are divided by a slit (42*c*) or cut. The widths (P, Q) of the recessed retainer are narrower than the width (R) of the tab. The inner width (Q) of the recessed retainer approximates or is larger than the width (S) of the tab, but the inner width (P) of the recessed retainer is narrower than the width (S) of the tab. If the connector (40) comprises a resilient but flexible material, the width (S) can be wider than the width (Q) before the connectors (40, 43) are interlocked, but the width (S) will be smaller than or will approximate the width (Q) of the recessed retainer when the connectors are interlocked.

Figure 9A:
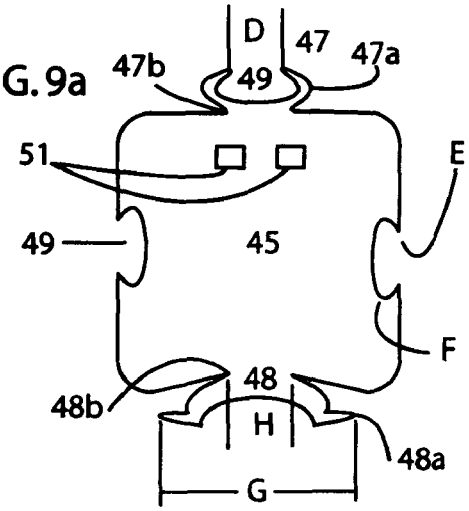
FIG. 9*a* depicts a top plan view of a ninth embodiment of a universal disc-shaped connector of the invention.

The prongs defining the recessed retainer and/or tab can be defined as needed. FIG. 9*a* depicts a connector (45) comprising plural recessed retainers (49) and plural tabs (47, 48). In this embodiment, the recessed retainer has a distal region with an inner width (E) that is narrower than the width (F) of the proximal region. Each tab is defined by two prongs; however, the prongs of the tabs are different. The tab (47) is defined by two inwardly extending prongs, which tabs also define a recessed retainer (49) having an inner distal width (D). The tab (47) comprises a proximal region (47*b*) which width is narrower than the corresponding distal region (47*a*). Accordingly, in one embodiment, a tab also serves as a recessed retainer since the prongs that define the tab also define a recessed retainer embedded within the tab. The tab (48) comprises two outwardly extending tabs having a wider (G) distal region (48*a*) and a narrower (H) proximal region (48*b*). The tab (48) is adapted to be retained by the recessed retainer (49) defined by the periphery of the connector and/or the prongs of the tab. Since two adjacent prongs can define a tab, two adjacent smaller apertures can define a recessed retainer. For example, the pair of adjacent apertures (51) in the connector (45) is adapted to interlock with the pair prongs of the tab (47 and/or 48) from another connector. The farthest most edges of the apertures would then define the widest width of a slot according to the invention. This widest width is larger than the proximal region of the tab and narrower than distal region of the tab with which the pair of apertures is adapted to interlock.

Figure 9B:
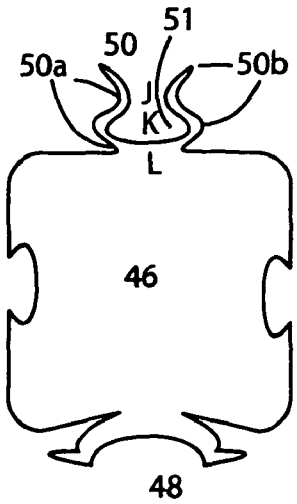
FIG. 9*b* depicts a top plan view of an alternate ninth embodiment of a universal disc-shaped connector of the invention.

FIG. 9*b* depicts the connector (46) that is substantially similar to the connector (45), the key difference being the difference between the tab (50) and the tab (47). The tab (50) comprises two multi-curved (or complex) prongs having two narrower first regions (50*a* having width L) and two wider second regions (50*b*). The tab (50) also comprises also defines a recessed retainer (51) having a wider first inner region (defined by width K) and a narrower second inner region (defined by width J). Therefore, the paired prongs define two tabs and one recessed retainer. The paired prongs are adapted to interlock with the recessed retainer (49), the tab (48) and/or the tab (47) of another connector. A combination tab/recessed retainer (50, 51, respectively) of the connector (46) is adapted to interlock with a simple tab, simple recessed retainer, and/or combination tab/recessed retainer of another connector (45).

Figure 10:
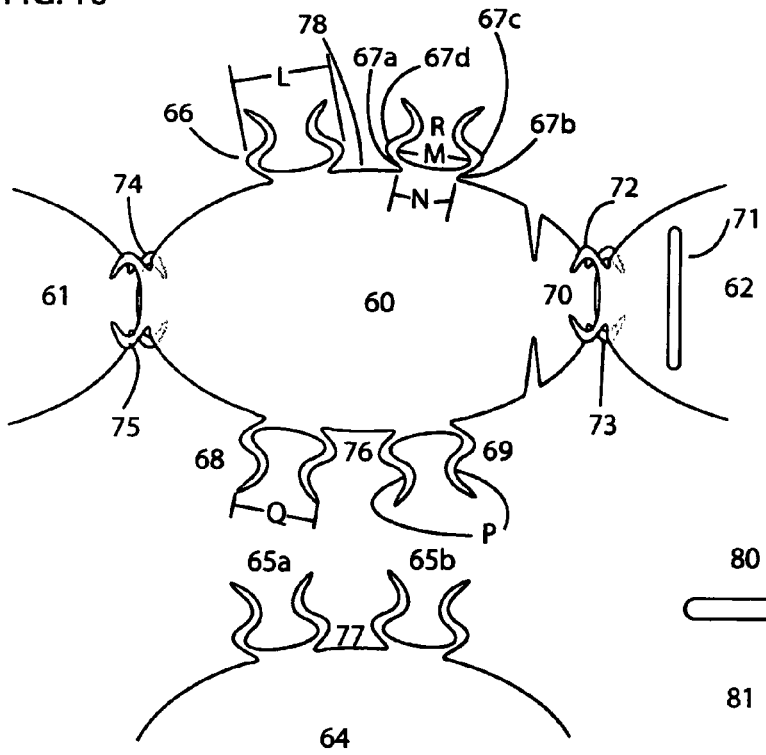
FIG. 10 depicts a top plan view of a tenth embodiment of a universal disc-shaped connector of the invention along with a partial top plan view of three other connectors, two of which are interlocked.

Adjacent tabs can define a recessed retainer. Likewise, adjacent recessed retainers can define a tab. FIG. 10 depicts a top plan view of four connectors (60-62, 64), three of which (60-62) are interlocked. Adjacent connectors (65*a*, 65*b*) define a recessed retainer (77) adapted to interlock with the tab of another connector. For example, the tabs (68 and 69) can individually interlock with the recessed retainer (77). The multi-curved prongs defining the tab (66, 67 see widths L and N) actually also define a recessed retainer between the prongs (see width M). Width L (distance from 67*c* to 67*d*) defines the outer width of a distal portion of the tab (66 or 67), and width N (distance from 67*a* to 67*b*) defines the outer width of a proximal portion of the same tab (respectively). Width M defines the inner width of the proximal region of a recessed retainer (defined by the prongs defining a tab), and width R defines the inner width of a distal region of the same recessed retainer. Since the prongs of the tab (66-68 or 69) are multi-curved, the prongs can define one or more tabs, one or more recessed retainers, or a combination thereof. In the exemplary embodiment of the connector (60), a pair of multi-curved prongs defines two tabs and a recessed retainer in one structure. For example, the tab (69) comprises a second proximal region having a width P narrower than a second distal region having a width Q, such that the second proximal and distal regions together define a second tab. In this embodiment, the width Q optionally approximates the width L, and the width P optionally approximates the width N. Also, the width M optionally approximates the width of the proximal region of the recessed retainer (78), and the width R optionally approximates the width of the distal region of the recessed retainer (78).

A connector can comprise plural different types of tabs and/or plural different types of recessed retainers. The connector (60) comprises at least five different types of tabs and at least three different types of recessed retainers. At each occurrence, a tab is dimensioned independently of another tab on the same connector. At each occurrence, a recessed retainer is dimensioned independently of another recessed retainer on the same connector.

The connectors (60, 61) are interlocked by way of respective paired prongs (74, 75), and the connectors (60, 62) are interlocked by way of respective paired prongs (72, 73). Each pair of prongs defines a recessed retainer and a tab. The paired prongs (74, 75) and (72, 73) are dimensioned similarly; however, as depicted, the respective tabs and recessed retainers can interlock in more than one fashion, i.e., the prongs (74, 75) are interlocked singly, and the prongs (72, 73) are interlocked doubly. In one embodiment, the paired prongs (74) are adapted to interlock with the pair multi-curved prongs (68).

The connector (60) also comprises a larger tab (70) adapted to interlock with the slot (71) of the connector (62). Accordingly, connectors can comprises different types of interlocking elements (mechanisms). Moreover, the connector (60) comprises stacked tabs (72, 73), and the stacked tabs can be the same or different.

As described herein, the connectors of the invention are substantially planar; however, they need not be completely flat. For example, the connectors (80, 81) depicted in FIG. 11 (depicted in front elevation) are planar. While the connector (80) is flat, the other connector (81) is ridged. Accordingly, a connector of the invention can have a jagged, ridged, flat, regular or irregular cross-sectional profile.

Figure 12:
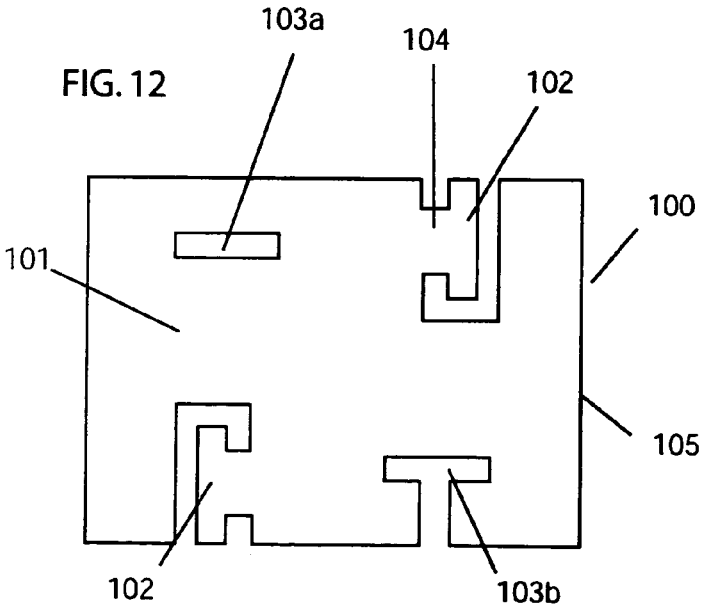
FIG. 12 depicts a top plan view of an eleventh embodiment of a connector of the invention.

The tongue member of the disc-shaped connector need not extend outwardly, i.e. radially, from the center of the connector. The tongue members can extend also inwardly toward the center of the planar body or at any angle between inward and outward extension. For example, FIG. 12 depicts a connector (100) having a tongue member (102) that extends in a direction substantially along a portion of the outer periphery (105) of the body (101) such that the widest portion of the tongue is approximately perpendicular to the outer periphery of the body. The tongue member (102) is attached to the body by way of the neck member (104) and is dimensioned to be inserted within either of the slot (103*a*) or the recessed retainer (103*b*) of another connector piece.

Figure 13A:
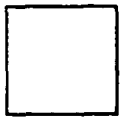
FIGS. 13*a*-13*n* depict top plan views of different exemplary embodiments of a slot that is optionally included in a connector.
Figure 13B:
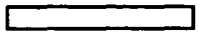
Figure 13C:
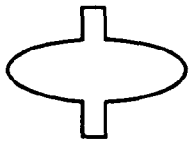
Figure 13D:
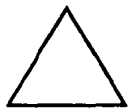
Figure 13E:
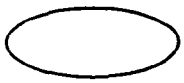
Figure 13F:
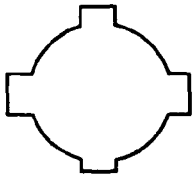
Figure 13G:
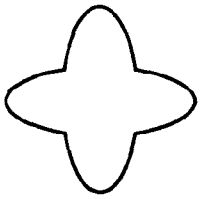
Figure 13H:
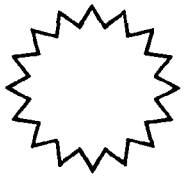
Figure 13N:
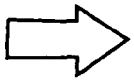
Figure 13I:
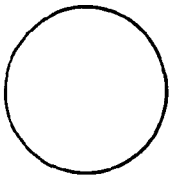
Figure 13J:
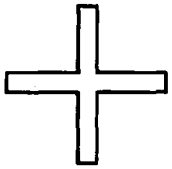
Figure 13K:
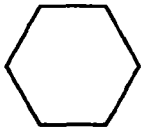
Figure 13L:
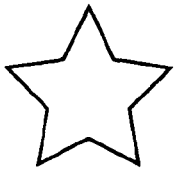
Figure 13M:
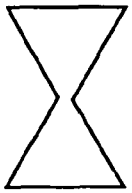

Although the slot of a connector can generally be of any desired shape, it should be so shaped as to permit complete insertion of a tongue member and at least temporary retention of the tongue member therein. The length of the slot can be larger but preferably approximates and more preferably is smaller than the width of the tongue member. Particular non-limiting and exemplary embodiments for the shape of the slot are depicted in FIGS. 13*a*-13*n* and can include a square (FIG. 13*a*), rectangle (FIG. 13*b*), combined rectangle and oval (FIG. 13*c*), triangle (FIG. 13*d*), oval (FIG. 13*e*), combined rectangles and circle (FIG. 13*f*), plural ovals (FIG. 13*g*), starburst (FIG. 13*h*), circle (FIG. 13*i*), cross (FIG. 13*j*), hexagon (FIG. 13*j*), multi-pointed star (FIG. 13*l*), intersecting geometric shapes such as intersecting triangles (FIG. 13*m*), arrow (FIG. 13*n*), multi-sided polygon, ellipse, trapezoid, parallelogram, pentagon, silhouette of any known, imaginary or fanciful person, place or thing and combinations thereof. It should be noted that plural slots can be disposed anywhere on a connector of the invention. They can be separate, connecting, or intersecting.

Figure 14A:
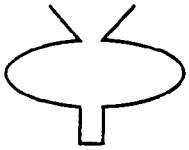
FIGS. 14*a*-14*k* depict top plan views of different exemplary embodiments of a recessed retainer in a connector.
Figure 14B:
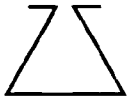
Figure 14C:
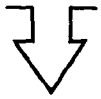
Figure 14D:
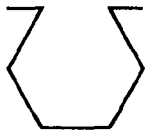
Figure 14E:
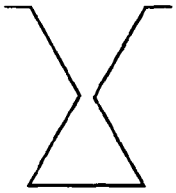
Figure 14F:
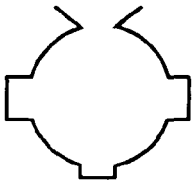
Figure 14G:
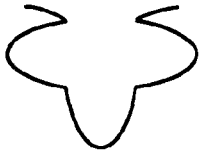
Figure 14H:
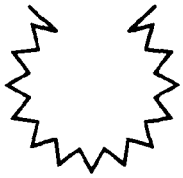
Figure 14I:
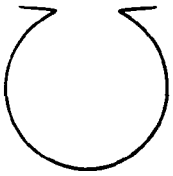
Figure 14J:
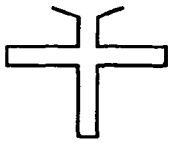
Figure 14K:
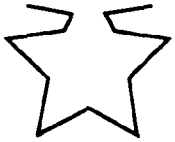

The recessed retainer can also be shaped as desired. It is only necessary that a recessed retainer have first region with a width narrower than the width of both the proximal and distal portions of tab and a second region with a width wider than the first portion and narrower than the widest portion of the tab. Exemplary non-limiting embodiments for the shape (top or bottom plan view, e.g. outline) of the recessed retainer are depicted in FIGS. 14*a*-14*k*, e.g. an intersecting oval and rectangle (FIG. 14*a*), triangle (FIG. 14*b*), arrow (FIG. 14*c*), pentagon (or polygon missing one or more sides; FIG. 14*d*), intersecting triangles (FIG. 14*e*), intersecting circle and rectangles/squares (FIG. 14*f*), intersecting ovals (FIG. 14*g*), multi-pointed star (FIG. 14*h*), circle (FIG. 14*i*), cross (FIG. 14*j*), and star (FIG. 14*k*).

In one embodiment, all of the connectors of the invention are interchangeable and interlockable, and a wide variety of semi-realistic models can be made with any given kit.

The individual construction kits contemplated by the invention will generally be provided with a plurality of tongue-and-recessed retainer connectors for constructing at least one semi-realistic model of anything such as, for example, a car, person, vehicle, animal, building, toy, weapon, machinery, caricatures, fanciful figure, caricature, geographic location, landmark, icon, molecule, atom, and the like.

The connectors of the invention can be provided individually, in groups comprising connectors, or generally as punch-outs from a punch-out card. In a punch-out card, outlines of the connectors are cut, die cut, etched, pressed, laser cut, printed, punched, or the like onto a suitable base sheet made of the desired material. When desired, the precut connectors are punched-out (or pressed or pushed out) from the base sheet and used. The connectors can also be provided unassembled or pre-assembled.

The above is a detailed description of particular embodiments of the invention. It is recognized that departures from the disclosed embodiments may be made within the scope of the invention and that obvious modifications will occur to a person skilled in the art. Those of skill in the art should, in light of the present disclosure, appreciate that many changes can be made in the specific embodiments which are disclosed herein and still obtain a like or similar result without departing from the spirit and scope of the invention. All of the embodiments disclosed and claimed herein can be made and executed without undue experimentation in light of the present disclosure.

What is claimed is:

1. An adaptive construction toy kit comprising plural edible, adaptive interlocking, interconnecting, press-fit, snap-fit, tongue-in-slot and/or tab-in-recessed retainer toy connectors that expand during use, the adaptive toy connector comprising:

a. a rigid, semi-rigid, or flexible material that expands when exposed to a predetermined condition during use, the material being selected from the group consisting of a heat expandable material, water expandable material, oil-based composition expandable material, non-aqueous composition expandable material, acidic composition expandable material, alkaline composition expandable material, organic solvent expandable material, and a combination thereof;

b. a shape independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; fanciful figure, person, place, or thing; silhouette thereof; and a combination thereof; and c. interlocking, interconnecting, press-fit, snap-fit, tongue-in-slot and/or tab-in-recessed retainer engagement means;

d. wherein during use an adaptive connector expands upon exposure to a predetermined condition, selected from the group consisting of heat, cold, moisture, an aqueous composition, an oil-based composition, a non-aqueous composition, acidic composition, alkaline composition, an organic solvent, and a combination thereof, such that a first adaptive connector is adapted to interlock and/or interconnect with a second adaptive connector before and/or after exposure to the predetermined condition, and wherein the adaptive connector maintains its physical integrity during use; and wherein the connector does not consist solely of resilient plastic, inflexible hard sugar candy, or semi-flexible, gelatin-containing sugared candy; and wherein the adaptive connector is edible.

2. The adaptive construction kit of claim 1, wherein the kit forms a model that changes in size and/or shape after exposure of the model to a predetermined condition.

3. The adaptive construction kit of claim 1, wherein the adaptive connector comprises starch, flour, oat, wheat, cellulose, rice, starch derivative, cellulose derivative, carbohydrate, carbohydrate derivative, sugar, protein, milk, whey, preservative, plasticizer, antioxidant, salt, flavor, bicarbonate, baking soda, yeast, oil, butter, glycerin, polymer, glycol, glycol derivative, grease, shortening, egg, albumin, adsorbent, buffering agent, desiccant, colorant, flavorant, sweetening agent, binder, disintegrant, opaquant or a combination thereof.

4. The adaptive construction kit of claim 1, wherein the first adaptive connector is adapted to interlock and/or interconnect with a second adaptive connector after exposure to the predetermined condition.

5. The adaptive construction kit of claim 1, wherein the first adaptive connector is adapted to interlock and/or interconnect with a second adaptive connector before exposure to the predetermined condition.

6. The construction kit of claim 1, wherein the adaptive connector comprises a material selected from the group consisting of dehydrated sponge, compressed sponge, hydrogel, gel, starch, flour, oat, wheat, cellulose, rice, starch derivative, cellulose derivative, carbohydrate, carbohydrate derivative, sugar, protein, milk, whey, preservative, plasticizer, antioxidant, salt, flavor, bicarbonate, baking soda, yeast, oil, butter, glycerin, polymer, glycol, glycol derivative, grease, shortening, egg, albumin, adsorbent, buffering agent, desiccant, colorant, flavorant, sweetening agent, binder, disintegrant, opaquant and a combination thereof.

7. An adaptive construction toy kit comprising plural edible, adaptive interlocking, interconnecting, press-fit, snap-fit, tongue-in-slot and/or tab-in-recessed retainer toy connectors that shrink during use, the adaptive toy connector comprising:

a. a rigid, semi-rigid, or flexible material that shrinks during use, the material being selected from the group consisting of a cold shrinkable material, desiccation shrinkable material, water shrinkable material, oil-based composition shrinkable material, non-aqueous composition shrinkable material, acidic composition shrinkable material, alkaline composition shrinkable material, organic solvent shrinkable material, and a combination thereof;

b. a shape independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; fanciful figure, person, place, or thing; silhouette thereof; and a combination thereof; and c. interlocking, interconnecting, press-fit, snap-fit, tongue-in-slot and/or tab-in-recessed retainer engagement means;

d. wherein during use an adaptive connector shrinks upon exposure to a predetermined condition, selected from the group consisting of cold, desiccation, moisture, an aqueous composition, an oil-based composition, a non-aqueous composition, acidic composition, alkaline composition, an organic solvent, and a combination thereof, such that a first adaptive connector is adapted to interlock and/or interconnect with a second adaptive connector before and/or after exposure to the predetermined condition, and wherein the adaptive connector maintains its physical integrity during use; and wherein the connector does not consist solely of resilient plastic, inflexible hard sugar candy, or semi-flexible, gelatin-containing sugared candy; and wherein the adaptive connector is edible.

8. The construction kit of claim 7, wherein the adaptive connector comprises a material selected from the group consisting of hydrogel, gel, starch, flour, oat, wheat, cellulose, rice, starch derivative, cellulose derivative, carbohydrate, carbohydrate derivative, sugar, protein, milk, whey, preservative, plasticizer, antioxidant, salt, flavor, bicarbonate, baking soda, yeast, oil, butter, glycerin, polymer, glycol, glycol derivative, grease, shortening, egg, albumin, adsorbent, buffering agent, desiccant, colorant, flavorant, sweetening agent, binder, disintegrant, opaquant and a combination thereof.

9. The adaptive construction kit of claim 7, wherein the kit forms a model that changes in size and/or shape after exposure of the model to a predetermined condition.

10. The adaptive construction kit of claim 7, wherein the first adaptive connector is adapted to interlock and/or interconnect with a second adaptive connector after exposure to the predetermined condition.

11. The adaptive construction kit of claim 7, wherein the first adaptive connector is adapted to interlock and/or interconnect with a second adaptive connector before exposure to the predetermined condition.

12. An adaptive construction toy kit comprising plural inedible, adaptive interlocking, interconnecting, press-fit, snap-fit, tongue-in-slot and/or tab-in-recessed retainer toy connectors that shrink during use, the adaptive toy connector comprising:

a. a rigid, semi-rigid, or flexible material that shrinks during use, the material being selected from the group consisting of a cold shrinkable material, desiccation shrinkable material, water shrinkable material, oil-based composition shrinkable material, non-aqueous composition shrinkable material, acidic composition shrinkable material, alkaline composition shrinkable material, organic solvent shrinkable material, and a combination thereof;

b. a shape independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; fanciful figure, person, place, or thing; silhouette thereof; and a combination thereof; and c. interlocking, interconnecting, press-fit, snap-fit, tongue-in-slot and/or tab-in-recessed retainer engagement means;

d. wherein during use an adaptive connector shrinks upon exposure to a predetermined condition, selected from the group consisting of cold, desiccation, moisture, an aqueous composition, an oil-based composition, a non-aqueous composition, acidic composition, alkaline composition, an organic solvent, and a combination thereof, such that a first adaptive connector is adapted to interlock and/or interconnect with a second adaptive connector before and/or after exposure to the predetermined condition, and wherein the adaptive connector maintains its physical integrity during use; and wherein the connector does not consist solely of resilient plastic, inflexible hard sugar candy, or semi-flexible, gelatin-containing sugared candy; and wherein the adaptive connector is inedible; and wherein the adaptive connector comprises a material selected from the group consisting of hydrogel and gel.

13. The adaptive construction kit of claim 12, wherein the kit forms a model that changes in size and/or shape after exposure of the model to a predetermined condition.

14. The adaptive construction kit of claim 12, wherein the first adaptive connector is adapted to interlock and/or interconnect with a second adaptive connector after exposure to the predetermined condition.

15. The adaptive construction kit of claim 12, wherein the first adaptive connector is adapted to interlock and/or interconnect with a second adaptive connector before exposure to the predetermined condition.

16. An adaptive construction toy kit comprising plural inedible, adaptive interlocking, interconnecting, press-fit, snap-fit, tongue-in-slot and/or tab-in-recessed retainer toy connectors that expand during use, the adaptive toy connector comprising:

a. a rigid, semi-rigid, or flexible material that expands when exposed to a predetermined condition during use, the material being selected from the group consisting of a heat expandable material, water expandable material, oil-based composition expandable material, non-aqueous composition expandable material, acidic composition expandable material, alkaline composition expandable material, organic solvent expandable material, and a combination thereof;

b. a shape independently selected at each occurrence from the group consisting of a square, rectangle, circle, oval, ellipse, trapezoid, parallelogram, pentagon, starburst, cross, multi-pointed star, intersecting geometric shapes, hexagon, heptagon, polygon, geometric shape, irregular shape, regular shape, symmetric shape, asymmetric shape; fanciful figure, person, place, or thing; silhouette thereof; and a combination thereof; and c. interlocking, interconnecting, press-fit, snap-fit, tongue-in-slot and/or tab-in-recessed retainer engagement means;

d. wherein during use an adaptive connector expands upon exposure to a predetermined condition, selected from the group consisting of heat, cold, moisture, an aqueous composition, an oil-based composition, a non-aqueous composition, acidic composition, alkaline composition, an organic solvent, and a combination thereof, such that a first adaptive connector is adapted to interlock and/or interconnect with a second adaptive connector before and/or after exposure to the predetermined condition, and wherein the adaptive connector maintains its physical integrity during use; and wherein the connector does not consist solely of resilient plastic, inflexible hard sugar candy, or semi-flexible, gelatin-containing sugared candy; and wherein the adaptive connector is inedible; and wherein the adaptive connector comprises a material selected from the group consisting of dehydrated sponge, compressed sponge, hydrogel, and gel.

17. The adaptive construction kit of claim 16, wherein the kit forms a model that changes in size and/or shape after exposure of the model to a predetermined condition.

18. The adaptive construction kit of claim 16, wherein the first adaptive connector is adapted to interlock and/or interconnect with a second adaptive connector after exposure to the predetermined condition.

19. The adaptive construction kit of claim 16, wherein the first adaptive connector is adapted to interlock and/or interconnect with a second adaptive connector before exposure to the predetermined condition.

* * * * *